United States Patent [19]

Sakurai

[11] Patent Number: 4,616,917

[45] Date of Patent: Oct. 14, 1986

[54] FIXING DEVICE

[75] Inventor: Masaaki Sakurai, Yokohama, Japan

[73] Assignee: Canon Kabushiki Kaisha, Tokyo, Japan

[21] Appl. No.: 542,103

[22] Filed: Oct. 14, 1983

[30] Foreign Application Priority Data

Oct. 20, 1982 [JP] Japan ..... 57-183996

[51] Int. Cl.[4] ..... G03G 15/00

[52] U.S. Cl. ..... 355/3 FU; 355/14 FU; 219/216; 219/469; 219/470

[58] Field of Search ..... 355/3 FU, 14 FU; 219/216, 469, 470; 29/132

[56] References Cited

U.S. PATENT DOCUMENTS 4,470,688 9/1984 Inagaki et al. ..... 355/3 FU

FOREIGN PATENT DOCUMENTS 55-55374 4/1980 Japan .
55-96970 7/1980 Japan .
2035901 6/1980 United Kingdom .

OTHER PUBLICATIONS

"Contact Electrification Across Metal-Dielectric and Dielectric-Dielectric Interfaces", Rose and Ward, Brit. J. Appl. Phys. 1957, vol. 8, p. 121.

*Primary Examiner*—Arthur T. Grimley
*Assistant Examiner*—David S. Warren
*Attorney, Agent, or Firm*—Fitzpatrick, Cella, Harper & Scinto

[57] ABSTRACT

A fixing device includes a first rotatable member and a second rotatable member for gripping and transporting a recording material to fix a material to be fixed having a predetermined electric polarity onto the recording material, the first rotatable member being positioned to be contacted with the face of recording material bearing the material to be fixed, and the second rotatable member to be contacted with a back face of the recording material, and at least one of the first and second rotatable members having a surface containing an electrification agent for generating electric charge through friction with the recording material for formation of an electrical field for attaching the material to be fixed onto the recording material.

44 Claims, 4 Drawing Figures

FIXING DEVICE

BACKGROUND OF THE INVENTION

1. Field of the Invention

This invention relates to an image fixing device to be used with a recording apparatus such as electrophotographic apparatus, electrostatic recording apparatus and others, and more particularly to an image fixing device in which a rotatable member is used for heating treatment, pressure treatment, or heating and pressure treatment for fixing a material to be fixed such as unfixed images onto a recording material.

2. Description of the Prior Art

In an image fixing device for an image forming apparatus in which unfixed images are fixed on plain paper, use has been frequently made of a system in which a fixing roller and a heating roller grip and transport a recording material such as plain paper.

Generally speaking, when a recording material (e.g. paper) supporting electrically an image formed with toner charged to positive or negative polarity is to be subjected to contact fixing, there will occur an off-set phenomenon, in which toner particles for forming toner images are deposited on a rotatable member such as roller or belt. In the prior art, for prevention of this phenomenon, a parting layer (comprising tetrafluoroethylene or silicone rubber) or a parting liquid (e.g. silicone oil) was formed on the surface of a rotatable member, but its preventing effect was insufficient. In addition to this, proposals for improvement are disclosed in Japanese Laid-open Patent Application Publication No. 55374/1980 (U.K. Patent Application GB 2035901 A) and Japanese Laid-open Patent Application Publication No. 96970/1980. According to one of these methods, a bias voltage of the same polarity as that of toner is applied externally on the rotatable member contacted with the toner image, while according to the other method, a bias voltage of the opposite polarity to that of toner is applied on the roller on the opposide side of the recording material bearing the toner image. Whereas, when the bias voltage is applied by means of a corona charger such as Corotoron, the device is made not only greater in scale and more complicated resulting in increased costs, but also arc discharging or leak will tend to occur when the corona charger is contaminated. Thus, such a corona charger was poor in reliability and safety. On the other hand, application by means of a bias roll can give only a practically small effect, and the bias roll was also impractically susceptible to contamination.

Further, when fixing is performed by pressure contacting a roller under a high pressure and at a relatively high speed, no solution of the problems is possible according to the method of the prior art, but such an operation will increase the force for permitting the toner to be offset. Such a force is liable to cause a complicated change in electrical field. Accordingly, the effect of preventing offset will become unstable. The device with such a great consumption of high voltage power requires excessive power, within a limited range of power, in addition to the power already required for fixing driving, exposure lamp, etc. as well as for heaters, and therefore a number of restrictions cannot but be imposed on the other devices.

Moreover, in the device of the prior art, not only the offset preventing effect was unstable, but also the toner image may sometimes suffer from scattering of toner which results in a disturbed image. Accordingly, when secondary copying (a copy of a copy of an original) was repeated for several times, the images frequently deteriorated.

SUMMARY OF THE INVENTION

An object of the present invention is to overcome the problems of the prior art as described above by minimizing the offset of a material to be fixed on a recording material onto the surface of a rotatable member for fixing and to stabilize its effect for a long time.

Another object of the present invention is to provide a sharp fixed image by prevention of a material to be fixed and charged to a certain polarity from being fixed a disturbed state on a recording material.

Still another object of the present invention is to provide an offset prevention effect superior to that of the prior art as well as improved sharpness of the fixed image are with a simple constitution and without excessive power consumption or cost.

Still another object of the present invention is to solve the problems in a fixing device when a rotatable member exhibiting high electrification because of a high speed, high pressure or a relatively thick electrically insulating surface is contacted with the surface of a recording material on the side opposite to the surface bearing a material to be fixed.

Further objects of the present invention will be understood from the following descriptions.

DESCRIPTION OF THE PREFERRED EMBODIMENTS

General description

The present inventors have discovered that generation of offset depends rather on formation of triboelectrical charge potential by contact and separation charge than on agglomerating force of toner or tack between the toner and the roller contacted with the toner. In view of this point, the present inventors have made a number of experiments and extensively studied to find out a theory as hereinafter described and also a way to put such a theory into practice.

Figure 1:
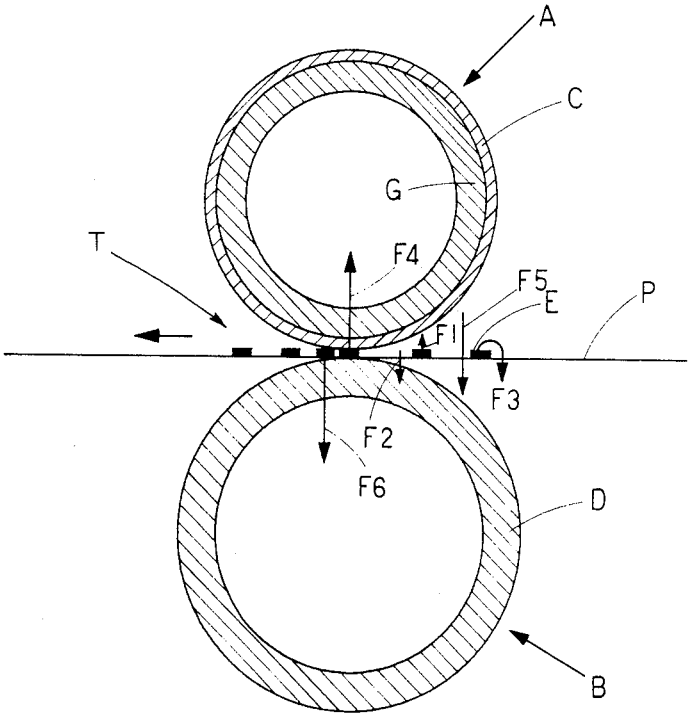
FIG. 1 shows a schematic drawing for illustration of offset generation concerning the present invention.

More specifically, the basic theory is first to be described in detail based on FIG. 1.

Referring now generally to a material to be fixed E, such as a toner image T or a resin material for coating, which is charged to a predetermined polarity, and to rotatable members A, B, the acting forces on such a material to be fixed may be classified broadly into:

the resultant force $\vec{FA}$ of tack $\vec{F1}$ acting between the first rotatable member A in contact with the material to be fixed E and the material to be fixed, agglomerating force $\vec{F2}$ between the components constituting the material to be fixed E, tack $\vec{F3}$ acting between the material to be fixed E and the recording material P; and the electrostatic resultant force FB of electrostatic force $\vec{F4}$ acting between the material to be fixed E and the first rotatable member A, electrostatic force $\vec{F5}$ acting between the material to be fixed E and the recording material P and electrostatic force $\vec{F6}$ acting between the material to be fixed and the second rotatable member B contacted with the recording material P on the side not contacted with the material to be fixed E. The major cause for offset generation lies for the most part in the electrostatic resultant force $\vec{FB}$ which is caused by the potential resulting from the triboelectric charge mutually produced between the material to be fixed, the first and the second rotatable members and the recording material.

Accordingly, if the overall force of the triboelectric charged potential comprising primarily the electrostatic resultant force $\vec{FB}$ has a positive component force which urges the material to be fixed toward the second rotatable member, generation of offset can be prevented to a great extent.

And, since the overall force may be deemed to be equivalent to the resultant electrostatic force $\vec{FB}$, the specific feature of the present invention resides, in order to bring the electrostatic force $\vec{FB}$ under appropriate conditions, in that an electrification agent is contained in at least one of the rotatable members A and B and utilizing, for prevention of offset, triboelectric charging with the recording material.

It has been found that the offset caused by the electrostatic forces is influenced by the potential established by the triboelectric charge, rather than the amount of the triboelectric charge.

According to the present invention, the resultant force of the force $\vec{FA}$ and the force $\vec{FB}$ are made to be directed toward the second rotatable member at all times and in any type of fixing devices to minimize the offset, by suitably selecting the triboelectric charge levels of the above three elements by making at least one of the rotatable members contain an electrification agent.

The solution provided by the present invention is based on the extensive study of the phenomenon during the fixing action and is intended to minimize the offset using the selection of the triboelectric charge level.

According to some specific embodiments, (1) an electrification agent having negative charging characteristics is contained in the first rotatable member in the case of a negatively charged material to be fixed; (2) an electrification agent having positive charging characteristics is contained in the second rotatable member in the case of a negatively charged material to be fixed; (3) an electrification agent having positive charging characteristics is contained in the first rotatable member in the case of a positively charged material to be fixed; (4) an electrification agent having negative charging characteristics is contained in the second rotatable member in the case of a positively charged material to be fixed; (5) an electrification agent chargeable to the polarity opposite to that of the paper is contained in the second rotatable member so as to enhance the potential of a recording paper, when the potential of the second rotatable member is lower than several times the potential of the recording paper, or when the fixing speed is low and there are also other combinations similar to these.

Particularly when the second rotatable member B is more readily charged to higher potential than the first rotatable member A, for example, when the surface charging layer D of the rotatable member B has a thickness greater than that of the surface charging layer C of the rotatable member A (G is a core metal), offset can be prevented to a considerable extent by applying the method according to the above item (2) or (4) wherein the charge polarity of the second rotatable member is made opposite to that of the material to be fixed.

As the device for which the item (2) or (4) can be effectively applied, there may be generally included a device in which the surface of the second rotatable member can be charged to a high potential (1000 V or higher). Charging will more readily occur and the potential of charging will tend to be elevated, as the speed of rotation is higher, or as the nip where the first and second rotatable members are press-contacted is increased in area, or as the thickness of the surface charging layer D is greater, or as the pressure between the first and the second rotatable members is increased. Most of the ordinarily practiced fixing devices satisfy these conditions, whereby the second rotatable member is charged to a high potential. Thus, in the present invention, by making the second rotatable member contain an electrification agent as shown in the item (2) or (4), the second rotatable member has been permitted to be endowed with a force attracting strongly the material to be fixed toward the recording material, whereby offset and disturbance of the material to be fixed could be prevented.

The term "contain" used in the present invention means comprehensively covers the actions of (1) adding to and mixing in a rotatable member, (2) adding to, mixing in and dispersing in a surface layer of a rotatable member and (3) using, when a surface layer of a rotatable member is produced, as a component thereof, a material chemically treated with an electrification agent.

The present invention can increase the service life of a rotatable member for fixing through the effect of preventing offset which may otherwise be caused by triboelectric charging, thus realizing saving of sources and decrease in the total cost.

Figure 2:
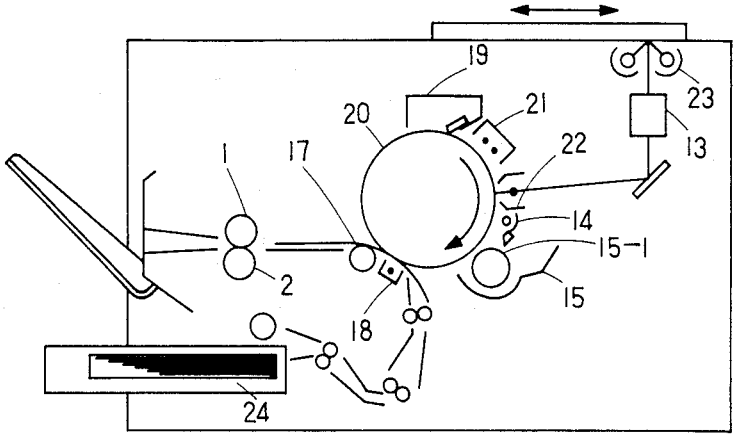
FIG. 2 shows a schematic drawing for illustration of an electrophotographic apparatus for which the present invention is applied.

First, an embodiment of an electrophotographic apparatus as shown in FIG. 2, for which the present invention is applied, is described, followed by the descriptions of the respective Examples 1 and 2.

The photosensitive material for formation of electrostatic latent images and the formation process as shown in FIG. 2, is based on the disclosure in Japanese Patent Publication No. 23910/1967, but the present invention is not limited to these and any of other known materials or processes may be applicable. Now, description is made about the device shown in the drawing.

A photosensitive drum 20 having a photosensitive layer provided on a metal cylinder is uniformly positively charged by a primary charger 21, subsequently charged again by a secondary charger 22 giving the polarity opposite to that of the primary charger 21, and at the same time exposed to a light image of an original by a lamp 23 and through an optical system 13. By doing so an electrostatic latent image is formed as the difference in the surface potential density corresponding to the light and dark pattern of the optical image on the surface insulating layer on the photosensitive drum 20, and then, the entire surface of the photosensitive layer is uniformly exposed by whole surface exposure lamp 14, thereby creating a difference in surface potential corresponding to the light and dark portions in the original image to form a highly contrasted electrostatic latent image, followed by development and visualization of the above latent image with a toner negatively charged through triboelectric charging with a developing sleeve 15-1 in a developing vessel 15.

As the next step, the back face of a supporting material 17 such as paper supplied from a cassette 24 is given positive charges from a transfer charger 18, and, by the electrostatic attracting force of the charges, the visualized image on the above photosensitive drum is transferred to the supporting material, followed by heat fixing of the transferred toner image by means of the rollers 1 and 2.

The drum 20 is cleaned by a blade cleaning means 19 for reuse.

Referring now to the specific examples based on the above general description, the present invention is further illustrated with reference to the drawings.

In the following, there are shown examples of a roller having a surface layer which contains an electrification agent in order for a material to be fixed to be attached to the recording material, or a fixing device having such a roller, in the case when a material to be fixed such as toner image or a resin member is charged to a predetermined polarity.

Figure 3:
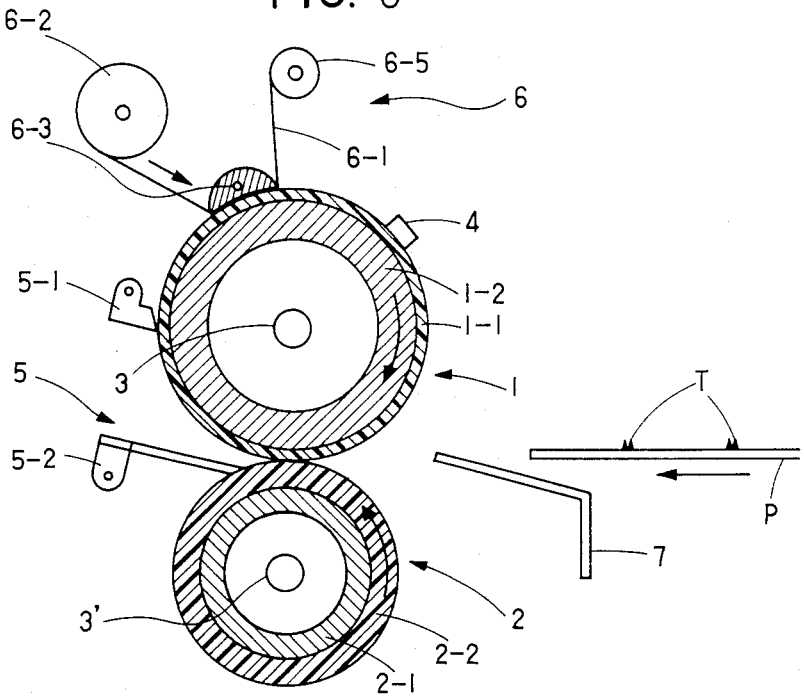
FIGS. 3 and 4 each show a sectional view for illustration of an embodiment of the present invention.
Figure 4:
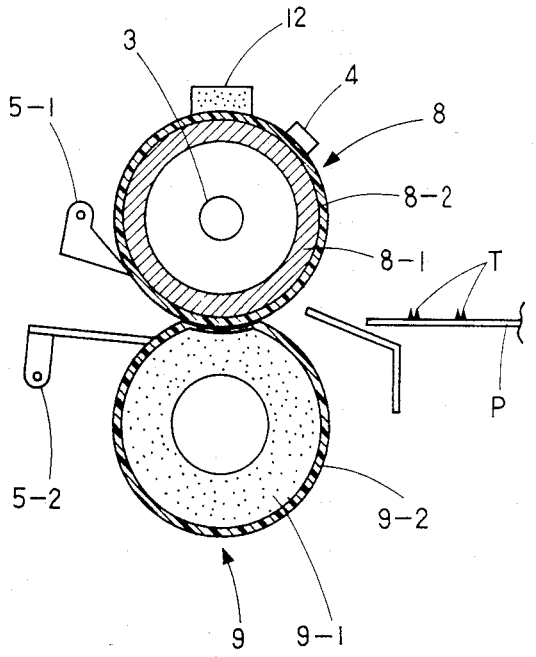

FIG. 3 and FIG. 4 show examples in which the surface layer of the rotatable member, contains an elecrification agent for charging positively through friction with plain paper.

EXAMPLE 1

FIG. 3 shows an embodiment in which a negatively charged toner image T formed by the electrophotographic process is fixed by means of a heat fixing device on the plain paper P.

The fixing device has a fixing roller 1 having internally a heater 3 such as a halogen heater, and it rotates in the direction of the arrow by receiving the driving force from a driving motor (not shown); a pressure roller 2 which rotates frictionally with pressure contact against the fixing roller 1. The fixing roller 1 consists of a hallow roller core 1-2 made of a metal such as aluminum, stainless steel or copper and heat-resistant resin layer 1-1 with a parting characteristic such as of tetrafluoroethylene resin with a thickness of 20 to 100 $\mu$ provided on the outer circumferential surface. The pressure roller 2 is supported rotatably on a bearing (not shown). The roller 2 is pressure contacted against the fixing roller 1 by a known pressure means at least during fixing, and it consists of a metallic roller core 2-1 and an insulating elastomer layer 2-2 such as of silicone rubber, fluorine rubber, or fluorosilicone rubber with a relatively large thickness (about 5 to 10 mm) provided on the outer circumferential surface. This structure is adopted with the view to ensuring the sufficient pressure contact region with the fixing roller. On the fixing roller 1 is arranged a thermosensitive element 4 such as thermistor or thermocouple in contact therewith, and its detection signal is led to a known controlling means (not shown) to maintain the temperature at the outer circumferential surface of the fixing roller 1 at the melting point of the toner image (by controlling the output of the heater 3 or the application voltage therefor).

Separation pawls 5-1 and 5-2 are provided for separating the recording materials from the rollers. A cleaning means 6 has a heat-resistant unwoven fabric web 6-1 to remove offset toner, foreign matter such as paper dust or the like, from the surface of the rotatable member. As for the material for the web 6-1, NOMEX (Tradename) is available.

The cleaning web 6-1 is contacted to the fixing roller 1 by an urging roller 6-3 of silicone rubber, fluorine rubber fluorosilicone rubber or silicone rubber sponge. The web 6-1 is continuously or successively moved at a low speed from the supply roll 6-2 by the take-up roll 6-5 which is driven, so that a fresh face of the web 6-1 is always contacted to the fixing roller 1.

A method for preparation of a roller applicable for this Example 1 is described below.

An unvulcanized silicone rubber is mixed with a filler of 20 parts by weight of AEROSIL 200, produced by Nippon Aerosil Co., commercially available fine powder of silica which is surface-treated by silane coupling agent having an amino group (structural formula: $H_2NCH_2CH_2CH_2Si(OCH_3)_3$), per 100 parts by weight of the unvulcanized rubber. The resultant mixture was thoroughly kneaded together with a vulcanizing agent and formed into an unvulcanized rubber sheet, which unvulcanized rubber sheet was then left to stand at normal temperature for 3 days.

Then, a stainless steel core metal with an outer diameter of 50 mm was subjected to blasting, thereafter coated with an adhesive, left to stand under an environment of 25° C. for 5 hours, followed by baking at 120° C. for 20 minutes. The above core metal was coated with the unvulcanized rubber sheet as prepared above and subjected to primary vulcanization (by means of a press vulcanizer) under a pressure of 150 kg/cm$^2$ at a temperature of 170° C. for 30 minutes, further to secondary vulcanization at 200° C. for 4 hours, followed by grinding to an outer diameter of 59.5 mm. Subsequently, the above roller was immersed in dimethyl silicone oil (having a viscosity of 100 cp at 25° C.) at 180° C. for 48 hours to be swelled therewith, followed by finishing polishing to an outer diameter of 60 mm, to provide a pressure roller.

The above roller is positioned to the positive order or level as compared with copy paper in the triboelectric charging level.

The above filler functions also as a rubber reinforcing filler so that the pressure roller can have a very high characteristics.

In FIG. 2, as the fixing roller 1, there was employed a roller having a PFA coating layer 1-2 of 30 $\mu$ in thickness on a roller core of an aluminum core metal of 60 mm in diameter and 7 mm in thickness and, as the pressure roller 2, a roller of 60 mm in outer diameter having on its outer surface a coating 2-2 of the above described thermovulcanizable type silicone rubber of 5 mm in thickness; those rollers were pressured contacted with each other under the total pressure of 60 kg, and copying was performed at a speed of 23 sheets of A3 size paper/min. (roller circumferential speed of 270 mm/sec).

After continuous passage of 99 sheets of paper, the surface potential on the pressure roller was found to be +3000 to +4200 V, the potential on the copy paper +270 V and the surface potential on the fixing roller −50 to −70 V. Thus, the electrostatic forces $\vec{F5}$ and $\vec{F6}$ are both directed to the pressure roller.

And, the toner offset onto the fixing roller was very small in amount to give a very good result.

EXAMPLE 2

The fixing device of the present invention to be used in an image forming apparatus, in which on N-type photosensitive member of various kinds of OPC (Organic PhotoConductor) are formed negative latent image and the negative latent images are then developed with a positive toner to be visualized, is illustrated by referring to FIG. 4 as described above.

In FIG. 4, as a fixing roller 8, there was employed a roller consisting of a core of a stainless steel core metal 8-1 of 24 mm in diameter and 0.5 mm in L thickness coated with a PFA coating layer 8-2 of 30 μ in thickness and, as a pressure roller 9, a roller of 24 mm in outer diameter consisting of an aluminum core metal of 14 mm in diameter and 4 mm in thickness covered with a silicone rubber sponge 9-1 with a sponge hardness (ASKER C) of 25, of which outer circumferential surface is further coated with a thermovulcanizable silicone rubber coating 9-2 of 1 mm in thickness containing fine silica powders which are applicable to the present invention, which rollers were pressured contacted with each other under the total pressure of 5 kg, and copying was performed at a speed of roller circumferential speed of 60 mm/sec on A4 size paper.

The surface potential on the pressure roller after passage of one sheet was found to be +700 V, the potential on the copy paper −200V, and the surface potential on the fixing roller −30 to −40 V. Thus, the forces $\vec{F4}$ and $\vec{F5}$ among the electrostatic forces are directed toward the pressure roller 2, which direction is desirable from the offset prevention standpoint but the force $\vec{F6}$ is directed toward the fixing roller 1, which direction is undesirable from the same standpoint. The force $\vec{F5}$, rather than the force $\vec{F6}$ is prevailing, so that the offset to the fixing roller is very small. Good results were obtained.

The pressure roller is so produced as to be given the more negative order or level than the copy paper in the triboelectric charge level. The method of producing it is the same as that having positive order or level as described hereinbefore, with the exception of the difference in the filler.

As for the filler, 20 parts by weight of commercially available AEROSIL 200 was used per 100 parts by weight of unvulcanized rubber. The formed and vulcanized pressure roller was at more negative level than the copy paper.

COMPARATIVE EXAMPLE 1

The same paper passage test was conducted by use of entirely the same fixing device and image forming apparatus as in Example 1, except for using, as the pressure roller 2, the roller having a thermovulcanizable type silicone rubber exhibiting negative triboelectric charge level as compared with the copy paper.

The surface potential on the pressure roller after passage of 99 sheets of paper was −6000 V or more (greater in absolute value, toward negative), the potential on copying paper +300 V and the surface potential on the fixing roller −50 to −70 V. Among the electrostatic forces, the forces $\vec{F4}$ and $\vec{F5}$ are directed toward the pressure roller to tend to prevent the offset, but the force $\vec{F6}$ is directed towardthe fixing roller to tend to increase the offset. However, the force $\vec{F6}$, rather than the force $\vec{F5}$ is prevailing. And, toner offset too much in amount to be cleaned at the cleaning web 6-1 was generated to result in lowering in copy quality.

COMPARATIVE EXAMPLE 2

The same paper passage test was conducted by use of entirely the same fixing device as in Example 2, except for using, as the pressure roller, the roller having a silicone rubber of the type vulcanizable at room temperature exhibiting negative charge level.

The surface potential on the pressure roller after passage of 1 sheet of paper was −800 V, the potential on copying paper +180 V and the surface potential on the fixing roller −30 to −40 V.

And, toner offset was appreciable.

Table 1 shows the amounts of offset toners in Example 1, Comparative Example 1, Example 2 and Comparative Example 2, respectively. The offset toner amount was shown in terms of the weight percentage (%) relative to the total toner amount on the copy paper.

TABLE 1

| | Example 1 | Comparative Example 1 | Example 2 | Comparative Example 2 |
|---|---|---|---|---|
| Amount of offset toner (%) | 0.03 | 0.6 | 0.06 | 0.15 |

From Table 1, it can be seen that the toner offset in Example 1 could be reduced to 1/20 of the amount of the prior art example (Comparative Example 1).

On the other hand, in Example 2, the toner offset could be reduced to 2/5 of the toner offset amount of the prior art example (Comparative Example 2). The reason for this effect is described below.

In the Example 1 in FIG. 3, wherein the toner is negatively charged, an electrification agent of positive polarity (to be charged through friction with a recording material) was added to the surface layer of the pressure roller 2 so that the pressure roller 2 is triboelectrically charged to the positive polarity. In a fixing apparatus used with the positive toner image, an electrification agent of negative polarity may similarly be added in order to use the same idea as with Example 1. Also, in Example 2 shown in FIG. 4, an electrification agent of positive polarity was added to the pressure roller 2 in the case of the positive toner, but in a fixing device used with the negative toner image, an electrification agent of negative polarity may be added to the pressure roller 2.

According to these Examples, there are shown particularly effective examples in which triboelectric charging levels of the pressure roller were changed, but the vector of the resultant force may be directed toward the side of the pressure roller by changing the triboelectric charging level of the fixing roller thereby to change $\vec{F4}$ and $\vec{F5}$ or $\vec{F4}$, $\vec{F5}$ and $\vec{F6}$.

It is more effective that the triboelectric charging level of that surface which is more readily charged to a high potential (e.g. a surface with great frictional coefficient) is changed.

In the constructions according to the foregoing Examples, the pressure roller is more easily charged to the high potential, due to its capacitance. Now, examples of the materials for the pressure rollers positioned at positive or negative in the triboelectric charging level relative to the copying paper are set forth below. When the elastomer layer of the pressure roller is silicone rubber and fine powder of silica is added thereto, most of them will be negative relative to the paper, that is, the pressure roller will be charged negatively (accordingly, the copying paper positively) through the triboelectric charging with the copying paper.

Group 1 of exemplary electrification agents

As the above-mentioned fine powder of silica, there are silica of the dry system method (fumed silica) and silica of the wet system method. Examples of the commercially available silica of the dry system method may include:

Trade names of Nippon Aerosil Co.:

AEROSIL 130, 200, 300, 380, TT600, MOX80, MOX170, COK84;

Trade names of CABOT Co.:

Cab-O-Sil M5, MS-7, MS-75, HS-5, EH-5;

Trade names of WACKER-CHEMIE GMBH:

Wacker HDK N20, V15, N20E, T30, T40;

Trade name of Dow Corning Co.:

D-C Finesilica;

Trade name of Fransil Co.:

Fransol

On the other hand, commercially available silica of the wet system silica method are exemplified as follows (trade named set forth on the left side, names of selling companies on the right):

| | |
|---|---|
| Carplex | Shionogi Seiyaku |
| Nipsil | Nippon Silica |
| Tokusil, Finesil | Tokuyama Soda |
| Bitasil | Taki Seihi |
| Silton, Silnex | Mizusawa Kagaku |
| Starsil | Kamishima Kagaku |
| Himezil | Ehime Yakuhin |
| Siloid | Fuji Devidson Kagaku |
| Hi-sil | Pittsburgh Plate Glass Co. |
| Durosil | Fiillstoff-Gesellschaft Marquart |
| Ultrasil | |
| Manosil | Hardman and Holden |
| Hoesch | Chemische Fabrik Hoesch K-G |
| Sil-Stone | Stoner Rubber Co. |
| Nalco | Nalco Chem. Co. |
| Quso | Philadelphia Quartz Co. |
| Santocell | Monsanto Chemical Co. |
| Imsil | Illinois Minerals Co. |
| Calcium Silikat | Chemische Fabrik Hoesch K-G |
| Calsil | Fiillstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabriken Bryer, A.-G. |
| Tufknit | Durham Chemicals, Ltd. |
| Sirmos | Shiraishi Kogyo |
| Starlex | Kamishima Kagaku |
| Fricosil | Taki Seihi |

The rotatable members such as belts or rollers added by these fine powders of silica are all positioned at the negative orders in the triboelectric charging level relative to the paper as the recording material. When it is added to rubber the amount is preferably 30 to 50 wt. parts per 100 wt. parts of the rubber material.

By adding to the rotatable member the fine powder of silica as mentioned above, a great negative surface potential can be generated on said rotatable member by triboelectric charging with paper. This is effective for the pressure roller 2 opposed to positive material to be fixed or the fixing roller 1 opposed to negative material to be fixed.

Group 2 of exemplary electrification agents

Silane coupling treatment:

A silane coupling agent represented by the formula: RmSiYn (wherein R is an alkoxy group or a chlorine atom, m is an integer of 1 to 3; Y is a hydrocarbon group having at least one kind or two or more kinds of amino group, vinyl group, glycidoxy group, mercapto group, methacryl group and ureido group, n is an integer of 3 to 1) is suitable.

By application of the silane coupling treatment within the outer surface layer of a rotatable member, as the more greater positive triboelectric charging is formed by friction between the rotatable member and the paper, the rotatable member is positioned to a more positive order relative to the paper in triboelectric charging level.

Otherwise, a material subjected to silane coupling treatment, for example, fine powder of silica (either from the dry system method or from the wet system method) subjected to this treatment may be added to the surface layer, or a silane coupling agent may be added. For example, as the compounds having vinyl groups, there may preferably be employed:

$H_2C{=}CHSiCl_3$ $H_2C{=}CHSi(OC_2H_5)_3$ $H_2C{=}CHCH_2SiCl_3$ $H_2C{=}CHCH_2Si(CH_3)Cl_2$ $H_2C{=}CHCH_2Si(CH_3)_2Cl$ $H_2C{=}CHCH_2Si(OC_2H_5)_3$ $H_2C{=}CHSi(OC_2H_4OCH_3)_3$ $(H_2C{=}CHCH_2)_2SiCl_2$ $(H_2C{=}CH)_2Si(OC_2H_5)_2$ $(H_2C{=}CH)_3SiOC_2H_5$

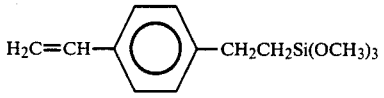

As the compound having glycidoxy group, there may be includes:

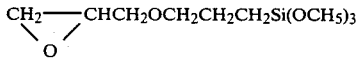

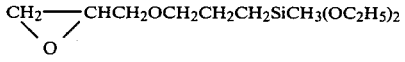

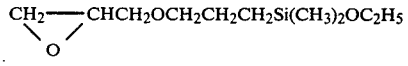

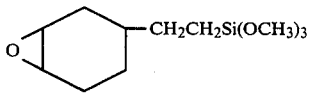

As the compound having mercapto group, there are:

$HSCH_2CH_2CH_2Si(OCH_3)_3$ $HSCH_2CH_2CH_2Si(OC_2H_5)_3$

The compound containing methacryl group may include:

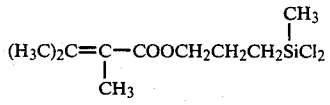

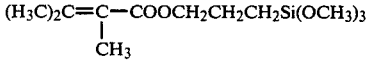

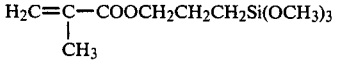

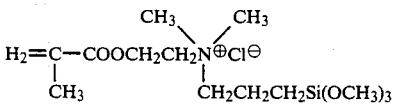

The compound having ureido group may be exemplified by:

$H_2NCONHCH_2CH_2CH_2Si(OC_2H_5)_3$

The silane coupling agents particularly preferably used in the present invention are compounds having amino group as represented by the following structural formulae:

$H_2NCH_2CH_2CH_2Si(OCH_3)_3$ $H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_5C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NH.CH_2CH_2CH_2Si(OCH_3)_3$ $H_3COCOCH_2CH_2NHCH_2CH_2NHCH_2CH_2CH_2Si(OCH_3)_3$ $(H_5C_2)_2N-CH_2CH_2CH_2Si(OCH_3)_3$

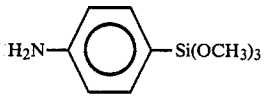

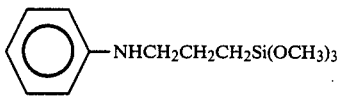

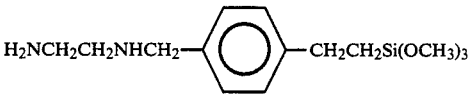

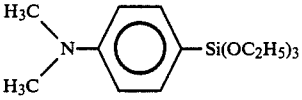

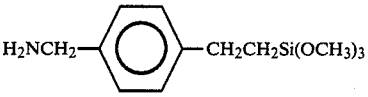

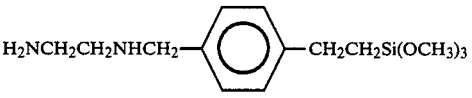

-continued $(HOCH_2CH_2)_2N-CH_2CH_2CH_2Si(OCH_3)_3$ $(H_3CO)_3SiCH_2CH_2CH_2-NHCH_2$
$(H_3CO)_3SiCH_2CH_2CH_2-NHCH_2$ $(H_5C_2O)_3SiCH_2CH_2CH_2$
$NH$
$(H_5C_2O)_3SiCH_2CH_2CH_2$ $H_3CNHCH_2CH_2CH_2Si(OC_2H_5)_3$ $H_2N(CH_2CH_2NH)_2CH_2CH_2CH_2Si(OCH_3)_3$ $H_3C-NHCONHC_3H_6Si(OCH_3)_3$ In the above compounds, the alkoxy group may be replaced by a chlorine atom. These silane coupling agents may be used as a single kind or as a mixed system of two or more kinds.

By providing a pressure roller thus having a negative surface or a positive surface so that the vector of the sum of F acting on the toner may be directed constantly toward the pressure roller side by way of coating as described above, there can be obtained a stable fixing apparatus which exhibits very small offset.

Also, since no special voltage applying means from outside such as a corona charger or bias roller is required, reliability, safety, cost, durability, etc. could also be greatly improved.

Further, by provision of an appropriate triboelectric charging level even when it is difficult to apply the surface potential of the roller from outside, even a high potential can be easily be accomplished according to the present invention.

In the above Examples, a heat fixing apparatus capable of acting most effectively has been shown, and in that case, the offset due to great tackiness during melting of toner can be reduced extremely well based on the construction and the technique as described above. Further, it is also possible to apply these Examples for a fixing apparatus in which calender treatment or coating treatment is applied, and also for a pressure fixing apparatus.

The above Examples are also preferably applied, in an apparatus in which a material to be fixed is fixed by gripping and transporting a recording material by the nip formed with two rotatable members (belts or rollers), to such a rotatable member that has a smaller capacitance C, for example, which has a thicker insulating layer in the case of rotatable members having the same diameters and equal dielectric constants. In other words, it is preferably applied to the rotatable member more readily charged to a high potential, and also it is preferable to apply to the side of the rotatable member which is not directly contacted with the toner image.

The effect of the present invention is markedly more excellent in the case when the polarity per se of the rotatable member for fixing is reversed by application of a specifically related electrification agent according to the present invention than in the case when the polarity of the rotatable member for fixing can be so stabilized to be several times or more that an electrical field capable of preventing offset of a material to be fixed onto a rotatable member. For example, in the prior art device having a recording material bearing a material to be fixed on one surface, the rubber roller as a rotatable member for pressurization which is not directly contacted with the material to be fixed will generally be triboelectrically charged negatively. In this case, by applying the present invention, namely by adding an electrification agent capable of changing the characteristics of a rotatable member (such an electrification agent is called as polarity-changing electrification agent), for example, a polarity-changing electrification agent such as a silane coupling agent, an excellent effect of the present invention can be obtained.

In the incorporation type as in the Example shown in FIG. 3, the electrification agent may have a mean primary particle diameter desirably within the range from 0.001 to 2 $\mu$ in view of dispersibility and charged state, particularly preferably fine powder within the range from 0.002 to 0.2 $\mu$ may be used.

The silica of the dry system method as mentioned above is obtained by, for example, a method utilizing pyrolytic oxidative reaction of silicon tetrachloride gas in oxygen-hydrogen flame, and the basic reaction scheme is represented as follows:

$$SiCl_4+2H_2+O_2 \rightarrow SiO_2+4HCl$$

Also, in this manufacturing step, it is possible to obtain a complex fine powder of silica with other metal oxides, but using halides of other metals such as aluminum chloride or titanium chloride together with the silicon halide compound, and these embodiments are also included.

On the other hand, the wet system method is a method which, for example, sodium silicate is neutralized with an acid, and the basic reaction scheme may be represented as follows:

$$Na_2O_mSiO_2+HCl+H_2O \rightarrow SiO_{2n}H_2O+NaCl$$

As the acid, there may also be employed, other than hydrochloric acid, sulfuric acid, nitric acid, phosphoric acid, carbon dioxide, sulfur dioxide and others.

In the above Examples, by using a pressure roller positioned to more a positive order relative to the paper as a recording material in the triboelectric charging level and applying such a pressure roller to a fixing device in an image forming apparatus having a negative image, toner offset caused by electrostatic force could be reduced extremely well with a simple construction.

The reasons for the above described effects will be explained.

As described above, the toner offset onto the fixing roller occurs when the resultant force of $\vec{FA}$ and $\vec{FB}$ is directed toward the fixing roller side, and therefore, for the prevention of toner offset, the resultant force of $\vec{FA}$ and $\vec{FB}$ may be directed toward the back face of the paper or the pressure (or pressurizing) roller side. In the above Example 2, by addition of a filler to the pressure roller, the pressure roller and the copy paper were changed in order in the triboelectric charging level, so that it is based on changing primarily $\vec{F5}$ and $\vec{F6}$. According to this Example, through the triboelectric and peel-off (separation) charging between the copy paper and the pressure roller, negative charges are imparted to the copy paper, while positive charges are imparted to the pressure roller. And, the distance to the toner image is nearer from the copy paper than from the pressure roller, and therefore the force $\vec{F5}$ was found to be prevailing as confirmed by the experiment, when the absolute values of the charged potentials on the copy paper and the pressure roller were comparable or when that of the pressure roller was lower than 3 times the other. More specifically, in the case where the potentials of the copy paper and the pressure roller satisfy the above conditions, this is suitable particularly when applied for an image forming apparatus employing a positive toner. The fixer satisfying the above conditions may be considered to be found in, for example, a so called low speed image forming apparatus, in which the fixing speed is low and the total pressure is low, or even with a high speed, in the case where the elastomer layer of the pressure roller has a very small thickness and the triboelectric charging potential is very low in spite of increase of triboelectric charges.

Next, when the charging potential on the pressure roller becomes about 10 or more times that on the copy paper, the toner offset onto the fixing roller was confirmed by the experiment to be controlled conversely by $\vec{F6}$. In the case when the $\vec{F6}$ becomes prevalent, namely the case when the absolute value of the potential on the pressure roller is overwhelmingly greater than that of the copy paper, this is suitable particularly when applied for an image fixing apparatus employing a negative toner, as in Example 1.

The above Examples can be particularly effectively applied to the second rotatable member pressure contacted to the first rotatable member in the case when the first rotatable member contacted with a material to be fixed has a relatively non-active surface or a thin parting layer. An excellent effect can be brought about in the case when the second rotatable member has an insulating layer having activity and further in the case when the insulating layer is thick.

The present invention can also very effectively be applied as a fixing device or rollers for fixing for an image forming apparatus having a means for development of latent images with toner as described above with reference to FIG. 2, whereby scattering of images can be prevented to a great extent.

The basic technique of the present invention resides in that an electrification agent to be charged through triboelectric charging with a recording material to a predetermined polarity is added to, mixed in and contained in the surface layer of a rotatable member for fixing a material to be fixed such as a toner image or tacky material, and that an electrical field by which the material to be fixed is held on the recording material, and/or an electrostatic force by which the material to be fixed is held on the recording material, is created by utilization of the triboelectric charging.

According to this technique, without requiring a large amount of power, sufficient offset reduction effect can be exhibited even in successive fixing, and there can be obtained a clear fixed state after fixing. The surface of the rotatable member charged to a predetermined polarity by containing an electrification agent can maintain stably an excellent offset prevention characteristic for a long term, and therefore this technique is economical and practical.

What is claimed is:

1. A fixing device for fixing material having a predetermined electric polarity to a face of a recording material, comprising:

a first rotatable member mounted to contact the face of the recording material which carries the material to be fixed;

a second rotatable member cooperable with said first rotatable member to transport therebetween the recording material, said second rotatable member having a surface layer adapted to contact a face of the recording material opposing said face that carries the material to be fixed;

wherein said surface layer of said second rotatable member contains an electrification agent which causes triboelectrical charging of the surface of said surface layer to a polarity opposite to the predetermined polarity to urge the material to be fixed toward the recording material, and wherein an electric field is formed between said surface layer and the material to be fixed and is stronger than an electric field formed in a region prior to entry of the recording material between said first and second rotatable members, by the potential of the recording material with respect to the material to be fixed.

2. A fixing device for fixing material having a predetermined electric polarity to a face of a recording material comprising:

a first rotatable member having a surface layer adapted to contact the face of the recording material which carries the material to be fixed;

a second rotatable member cooperable with said first rotatable member to transport therebetween the recording material, said second rotatable member having a surface layer adapted to contact a face of the recording material opposing said face that carries the material to be fixed, said surface layer of said second rotatable member having an electrostatic capacity smaller than that of the surface layer of said first rotatable member;

wherein said surface layer of said second rotatable member contains an electrification agent of a polarity opposite to the predetermined polarity to cause triboelectrical charging of the surface of said surface layer of said second rotatable member to the opposite polarity to urge the material to be fixed toward the recording material.

3. A fixing device for fixing material having a predetermined electric polarity to a face of a recording material, comprising:

a first rotatable member mounted to contact the face of the recording material which carries the material to be fixed;

a second rotatable member cooperable with said first rotatable member to transport therebetween the recording material, said second rotatable member having a surface layer adapted to contact a face of the recording material opposing said face that carries the material to be fixed, said surface layer being so insulative that it is electrically chargeable to a potential of not less than 10 times a potential of the recording material charged to a polarity opposite to the predetermined polarity, and said surface layer containing an electrification agent, which causes triboelectric charging, on the surface of said surface layer, sufficient to charge the surface to the opposite polarity to establish an electric field which is effective to urge the material to be fixed toward the recording material.

4. A fixing device for fixing material having a predetermined electric polarity to a face of a recording material, comprising:

a first rotatable member having a surface layer adapted to contact the face of the recording material which carries the material to be fixed;

a second rotatable member cooperable with said first rotatable member to transport therebetween the recording material, said second rotatable member having a surface layer adapted to contact a face of the recording material opposing said face that carries the material to be fixed;

wherein the surface layer of said first rotatable member has a chargeable potential which is lower than that of the surface layer of said second rotatable member; wherein the surface layer of said second rotatable member contains an electrification agent which causes triboelectric charging sufficient to charge the surface of said second rotatable member surface layer to the polarity opposite to the predetermined polarity to establish an electric field which is effective to urge the material to be fixed toward the recording material.

5. A fixing device for fixing material having a predetermined electric polarity to a face of a recording material, comprising:

a first rotatable member having an insulating surface layer of a predetermined thickness adapted to contact the face of the recording material which carries the material to be fixed;

a second rotatable member cooperable with said first rotatable member to transport therebetween the recording material, said second rotatable member having an insulating surface layer of a thickness greater than that of the thickness of said surface layer of said first rotatable member and adapted to contact a face of the recording material opposing said face that carries the material to be fixed, said surface layer of said second rotatable member containing, in its surface portion, an electrification agent which causes triboelectric charging sufficient to charge the surface thereof to a polarity opposite to the predetermined polarity to establish an electric field which is effective to urge the material to be fixed toward the recording material.

6. A fixing device according to any one of claims 1 to 5, wherein the surface of said first rotatable member is of an inactive resin, while the surface of said second rotatable member is of a rubber containing an electrification agent.

7. A fixing device according to claim 6, wherein the surface of said second rotatable member is mainly of a silicone rubber.

8. A fixing device according to claim 7, wherein the surface of said first rotatable member is mainly of a fluorine resin.

9. A fixing device according to claim 8, wherein the material to be fixed is a toner image formed by electrophotography on paper which is the recording material.

10. A fixing device according to claim 9, wherein said second rotatable member has a triboelectrically chargeable insulating surface containing an electrification agent.

11. A fixing device according to claim 6, wherein said rubber surface contains 100 wt. parts of rubber material and 3–50 wt. parts of the electrification agent added thereto.

12. A fixing device according to claim 6, wherein the polarity of the material to be fixed is positive, and the recording material is paper, and wherein said electrification agent contains fine silica powder.

13. A fixing device according to claim 6, wherein the polarity of the material to be fixed is negative, and the recording material is paper, and wherein said electrification agent contains amino group.

14. A fixing device according to claim 13, wherein the electrification agent is a fatty acid amide.

15. A fixing device according to claim 6, wherein the polarity of the material to be fixed is negative, and the reocrding material is paper, and wherein said electrification agent contains fine power of silica subjected to silane coupling treatment.

16. A fixing device according to claim 6, wherein the polarity of the material to be fixed is negative, and the recording material is paper, and wherein said electrification agent contains a silane coupling agent.

17. A fixing device according to any one of claims 1-5, wherein the surface of said first rotatable member contains an electrification agent triboelectrically chargeable to the same polarity as that of said material to be fixed to form an electrical field for attaching said material to be fixed onto the recording material.

18. A fixing device according to claim 17, wherein the surface of said second rotatable member is of rubber, and contains 100 wt. parts of the rubber and 3-50 wt. parts of the electrification agent.

19. A fixing device according to claim 17, wherein the surface of said second rotatable member is of rubber, and wherein the material to be fixed is a toner image formed by electrophotography on paper which is the recording material.

20. A fixing device according to any one of claims 1-5, wherein the polarity of the material to be fixed is positive, and the recording material is paper, and wherein said electrification agent contains fine silica powder.

21. A fixing device according to any one of claims 1-5, wherein the polarity of the material to be fixed is negative, and the recording material is paper, and wherein said electrification agent contains amino group.

22. A fixing device according to claim 21, wherein the electrification agent is a fatty acid amide.

23. A fixing device according to any one of claims 1-5, wherein the polarity of the material to be fixed is negative, and the recording material is paper, and wherein said electrification agent contains fine powder of silica subjected to silane coupling treatment.

24. A fixing device according to any one of claims 1-5, wherein the polarity of the material to be fixed is negative, and the recording material is paper, wherein said electrification agent contains a silane coupling agent.

25. A fixing device for fixing material having a predetermined electric polarity to a face of a recording material, comprising:

a first rotatable member adapted to contact the face of the recording material which carries the material to be fixed;

a second rotatable member cooperable with said first rotatable member to transport therebetween the recording material, said second rotatable member having a surface layer adapted to contact a face of the recording material opposing the face that carries the material to be fixed;

wherein said surface layer of said second rotatable member contains an electrification agent of the same polarity as the predetermined polarity, which triboelectrically charges the surface of said surface layer to the predetermined polarity and triboelectrically charges said opposing face of the recording material to a polarity opposite to the predetermined polarity; and wherein an electric field is formed between the surface layer and the material to be fixed which is weaker than an electric field formed in a region prior to entry of the recording material between said first and second rotatable members, by the potential of the recording material with respect to the material to be fixed.

26. A fixing device according to claim 25, wherein the surface of said first rotatable member is of an inactive resin, while the surface of said second rotatable member is of a rubber containing an electrification agent.

27. A fixing device according to claim 26, wherein the surface of said second rotatable member is mainly of a silicone rubber.

28. A fixing device according to claim 27, wherein said second rotatable member has a sponge layer under the surface thereof.

29. A fixing device according to claim 28, wherein the surface of said first rotatable member is mainly of fluorine resin.

30. A fixing device for fixing material having a predetermined electric polarity to a face of a recording material, comprising:

a first rotatable member adapted to contact the face of the recording material which carries the material to be fixed;

a second rotatable member cooperable with said first rotatable member to transport therebetween the recording material, said second rotatable member having a surface layer adapted to contact a face of the recording material opposing the face which carries the material to be fixed, said surface layer being so insulative that it is electrically chargeable to a potential of not more than 3 times a potential of the recording material charged in the polarity opposite to the predetermined polarity, and said surface layer containing an electrification agent which causes triboelectric charging to charge said surface layer to the predetermined polarity, thus charging the second rotatable member to the predetermined polarity and charging the opposing face of the recording material to the opposite polarity.

31. A fixing device according to claim 30, wherein said surface layer of said second rotatable member is mainly of a silicone rubber and a sponge layer thereunder.

32. A fixing device according to claim 31, wherein the surface of said first rotatable member is mainly of fluorine resin.

33. A fixing device according to any one of claims 26, 27, 28, 29, 31, 32 wherein said rubber surface contains 100 wt. parts of rubber material and 3-50 wt. parts of the electrification agent added thereto.

34. A fixing device according to any one of claims 25, 30, 26 or 32, wherein the surface of said first rotatable member contains an electrification agent for triboelectrically charging the surface to the polarity, the same as that of the material to be fixed to form an electric field for attaching the material to be fixed to the recording material.

35. A fixing device for fixing material having a predetermined electric polarity to a face of a recording material, comprising:

a first rotatable member mounted to contact the face of the recording material which carries the material to be fixed;

a second rotatable member cooperable with said first rotatable member to grip and transport therebetween the recording material to fix the material to be fixed onto the recording material, said second rotatable member being mounted to contact a back face of the recording material opposing said face that carrier the material to be fixed;

wherein at least one of said first and said second rotatable members contains in its surface portion a dispersed electrification agent that causes immediate triboelectrification which urges the material to be fixed toward the recording material upon said first and second rotatable members gripping and transporting the recording material and wherein the surface containing the electrification agent is sufficiently insulating as to be more highly chargeable than the other rotatable members.

36. A fixing device according to claim 35, wherein said rotatable member containing said electrification agent is said first rotatable member, said first rotatable member being triboelectrically charged to the same polarity as that of said mateial to be fixed to form an electrical field for holding said material to be fixed on the recording material.

37. A fixing device according to any one of claims 25, 35, 26 or 32, wherein the surface of the rotatable member containing the electrification agent is a triboelectrically chargeable insulating surface.

38. A fixing device according to claim 37, wherein said surface contains 100 wt. parts of the main content of the surface and 3–50 wt. parts of the electrification agent added thereto.

39. A fixing device according to claim 38, wherein the material to be fixed is a toner image formed by electrophotography on paper which is the recording material.

40. A fixing device according to any one of claims 36, 25, 30, 35 or 26, 27, 28, 31, 29, 32, wherein the polarity of the material to be fixed is positive, and the recording material is paper, and wherein said electrification agent contains amino group.

41. A fixing device according to claim 40, wherein the electrification agent is a fatty acid amide.

42. A fixing device according to any one of claims 36, 25, 30, 35, 26, 27, 28, 31, 29, or 32, wherein the polarity of the material to be fixed is positive, and the recording material is paper, wherein said electrification agent contains fine powder of silica subjected to silane coupling treatment.

43. A fixing device according to any one of claims 36, 25, 30, 35, 26, 27, 28, 31, 29, or 32, wherein the polarity of the material to be fixed is positive, and the recording material is paper, wherein said electrification agent contains a silane coupling agent.

44. A fixing device according to any one of claims 36, 25, 30, 35, 26, 27, 28, 31, 29, or 32, wherein the polarity of the material to be fixed is negative, and the recording material is paper, and wherein said electrification agent contains fine silica powder.

* * * * *

UNITED STATES PATENT AND TRADEMARK OFFICE

CERTIFICATE OF CORRECTION

PATENT NO. : 4,616,917

DATED : October 14, 1986

INVENTOR(S) : MASAAKI SAKURAI

It is certified that error appears in the above-identified patent and that said Letters Patent is hereby corrected as shown below:

Column 2, line 14, after "fixed" (second occurrence) insert --under--;

line 19, change "are" to --all--;

line 66, change "FB" to --$\vec{FB}$--

Column 7, line 3, delete "L".

Column 12, line 26, change "F" to --$\vec{F}$--.

Column 19, line 10 (Claim 35, line 13), change "carrier" to --carries--;

line 26 (Claim 36, line 5), change "mateial" to --material--.

Signed and Sealed this

Thirtieth Day of December, 1986

*Attest:*

DONALD J. QUIGG

*Attesting Officer*

*Commissioner of Patents and Trademarks*